US006023959A

United States Patent [19]

Stratton

[11] Patent Number: 6,023,959

[45] Date of Patent: Feb. 15, 2000

[54] TOOL FOR BENDING A CEILING SUPPORT ROD

[76] Inventor: John Stratton, 130 Fir St., Henderson, Nev. 89015

[21] Appl. No.: 09/334,201

[22] Filed: Jun. 16, 1999

[51] Int. Cl.[7] ..... B21D 7/02

[52] U.S. Cl. ..... 72/458; 72/479

[58] Field of Search ..... 72/217, 458, 479, 72/319, 320, 321, 387

[56] References Cited

U.S. PATENT DOCUMENTS

| | | | |
|---|---|---|---|
| 2,857,792 | 10/1958 | McNish | 72/458 |
| 2,957,499 | 10/1960 | James, Jr. . | |
| 3,330,309 | 7/1967 | Horvath, Jr. . | |
| 3,732,721 | 5/1973 | Cusimano | 72/458 |
| 4,751,840 | 6/1988 | Windsor, Jr. . | |
| 5,161,404 | 11/1992 | Hayes | 72/458 |
| 5,303,748 | 4/1994 | Haldemann . | |
| 5,518,044 | 5/1996 | Ferguson . | |
| 5,819,581 | 10/1998 | Winton, III | 72/458 |
| 5,901,600 | 5/1999 | Decker et al. | 72/388 |
| 5,934,138 | 8/1999 | Semien | 72/458 |

*Primary Examiner*—David Jones
*Attorney, Agent, or Firm*—Kenneth L Tolar

[57] ABSTRACT

A tool for bending ceiling support rods includes a pair of reciprocable spring biased handle members, each having ajar at an upper end thereof. A rod bending bar is pivotally joined to the handle members immediately below the jaws. The bending bar includes a measurement wire having indica thereon for aligning with an externally projected laser beam so that a user may grip and bend each support rod at a desired height above the floor. The jaws are tightly secured about a rod at the desired height and the rod is bent back onto itself using the pivotable bending bar. The device assists a user in installing a level ceiling support system.

6 Claims, 3 Drawing Sheets

TOOL FOR BENDING A CEILING SUPPORT ROD

BACKGROUND OF THE INVENTION

The present invention relates to a uniquely designed tool that allows a user to bend each of multiple ceiling support rods at an identical distance from the floor to assure that the ceiling is level.

DESCRIPTION OF THE PRIOR ART

Ceilings often include a horizontal, lattice framework or "stringers" which support individual ceiling tiles. The framework is suspended a predetermined distance above the floor with a plurality of wire rods embedded within or attached to a second ceiling disposed above the suspended ceiling. Each rod must be bent at the same distance from the floor to assure that the ceiling is level. In addition, each rod is bent to form a substantially U-shaped loop having a predetermined width at the lower end thereof. Bending each rod in such a fashion using pliers and other conventional tools is cumbersome, time consuming and tedious. The present invention overcomes the aforementioned problems by providing a uniquely designed tool which allows a user to easily bend ceiling support rods at an exact distance from the floor to form a loop having a desired width.

Various tools for bending ceiling support wires and other objects exist in the prior art. For example, U.S. Pat. No. 2,85,7792 issued to McNish relates to a hand tool bender for bending ceiling support rods. The design allows the device to be temporarily secured to the wire rod whereby the user may bend the rod with one hand. The device includes a strap having a handle pivotally attached to the lower end thereof. An end of the handle includes a roller which engages the rod when the handle is pivoted. The strap includes means for gripping the wire rod whereby a user may bend the rod by simply pivoting the handle. The device, however, does not include means for determining the appropriate distance from the bent portion to the floor nor does it provide a means for assuring that the bent portion has a select width.

U.S. Pat. No. 5,518,044 issued to Ferguson relates to a fence clip wire twister tool.

U.S. Pat. No. 5,303,748 issued to Haldemann relates to a fencing tool.

U.S. Pat. No. 4,751,840 issued to Windsor, Jr. relates to an electrician's wire bending tool with mandrels.

U.S. Pat. No. 3,330,309 issued to Horvath, Jr. relates to a wirebound box closing tool.

U.S. Pat. No. 2,957,499 issued to James, Jr. relates to a bending tool.

The present invention provides a uniquely designed tool that is easy to use and which allows a user to readily determine the appropriate location to bend the wire rod.

SUMMARY OF THE INVENTION

The present invention relates to a uniquely designed tool which allows a user to bend a ceiling support rod at a desired distance from the floor. The device comprises a pair of elongated spring-biased reciprocating handles, each having an open jaw at the top end thereof for accommodating and gripping a ceiling support rod. An elongated bending bar is pivotally joined to the handles at a position adjacent the jaws. A sleeve is attached to the bending bar for receiving a measuring wire which, when used in conjunction with a laser beam, allows a user to place the tool at a precise position on the rod. By bending each rod at an identical distance from the floor, a user can assure that the ceiling support frame is level. It is therefore an object of the present invention to provide a tool that allows a user to precisely bend multiple ceiling support rods at an identical distance from the floor.

It is another object of the present invention to provide a hand held tool that allows a user to quickly and conveniently bend a ceiling support rod. Other objects, features and advantages of the present invention will become readily apparent from the following detailed description of the preferred embodiment when considered with the attached drawings and the appended claims.

DESCRIPTION OF THE PREFERRED EMBODIMENT

Figure 3:
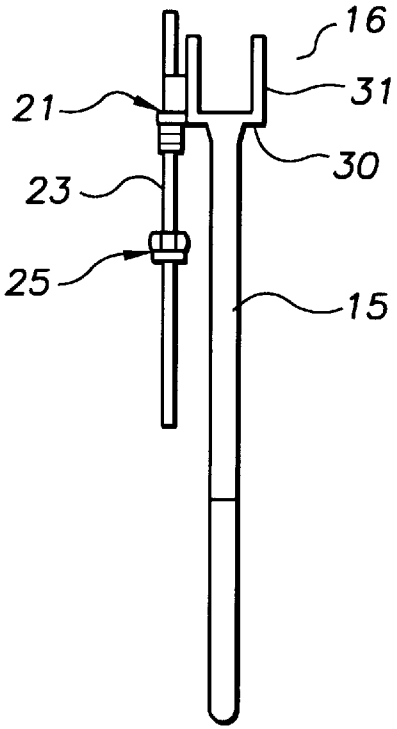
FIG. 3 is a front view of the wire bending portion.
Figure 2:
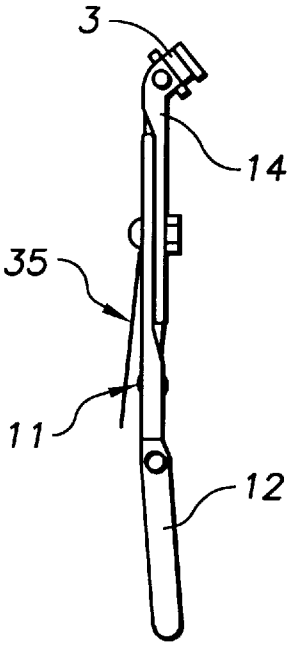
FIG. 2 is a side view of one of the handles of the wire gripping portion.
Figure 1:
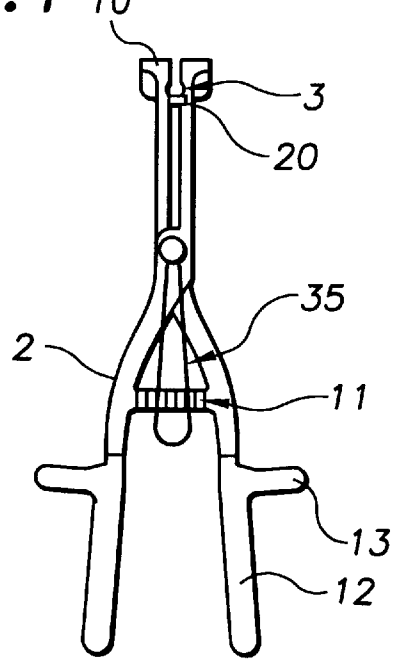
FIG. 1 is a plan, front view of the wire gripping portion of the present invention.
Figure 6:
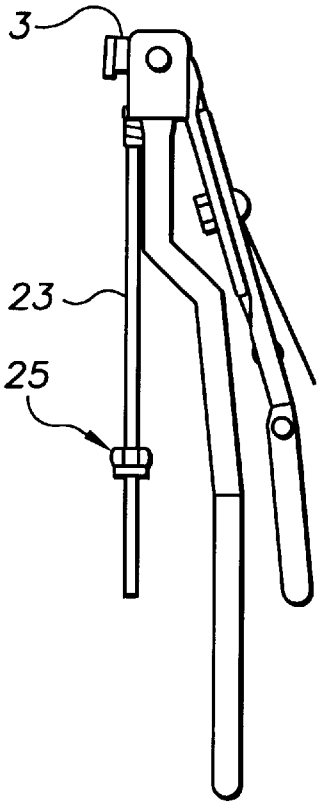
FIG. 6 is a side view of the entire assembly.
Figure 5:
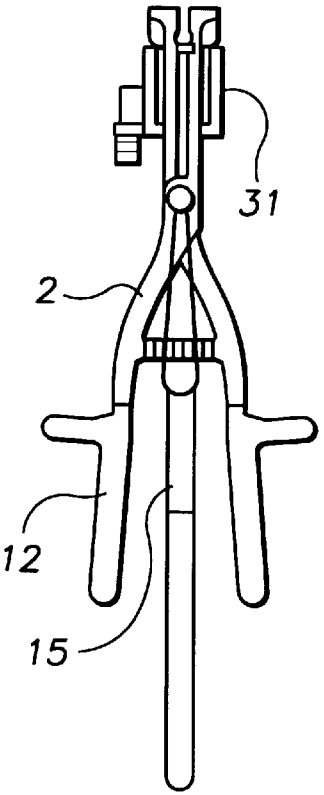
FIG. 5 is a front view of the entire assembly.
Figure 4:
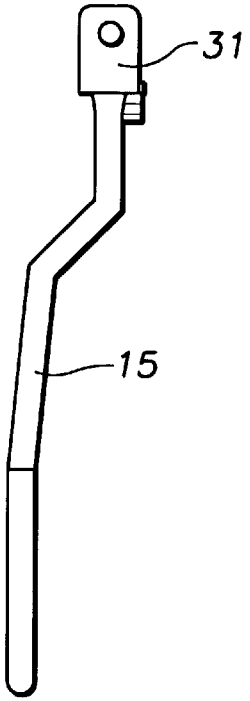
FIG. 4 is a side view of the wire bending portion.
Figure 7:
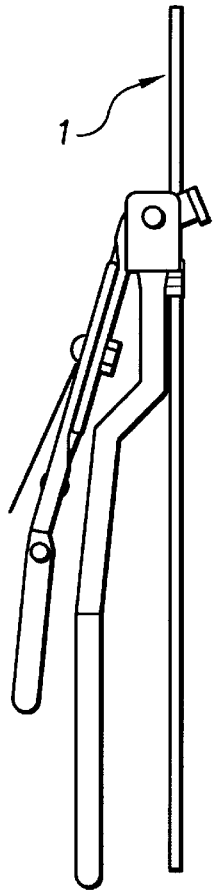
FIG. 7 depicts the assembly attached to a wire support rod.
Figure 8:
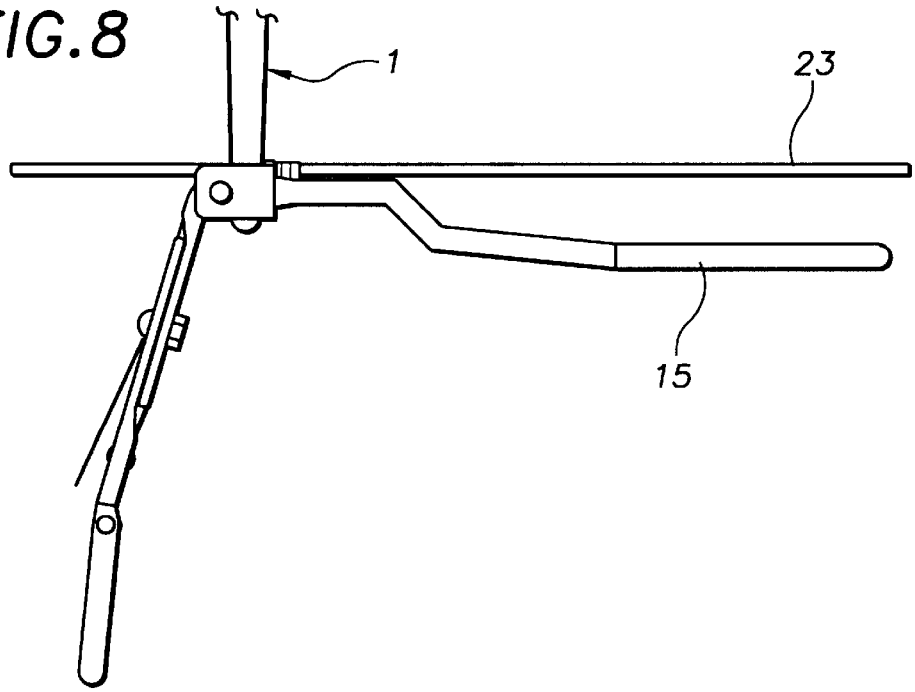
FIG. 8 depicts the device attached to a wire support rod and illustrates how the tool is used.

Referring now to FIGS. 1 through 8, the present invention relates to a tool for bending ceiling support rods 1. The device comprises a pair of elongated handle members 2, each pivotally joined to the other at an intermediate portion thereof allowing the handle members to be reciprocated. The upper end of each handle member includes an open jaw 3 for receiving and gripping a ceiling support rod. When the jaws are closed, they form a cylindrical bore that receives the rod. At a lower portion of each jaw is a stop member 20 that retains the wire rod within the jaws. At the upper portion of each jaw is a flared portion 10 that extends a predetermined distance from the jaws so that when the rod is bent therearound, a loop having a select width is formed. A spring 11 is disposed between the handle members to bias the handle members, and thus the jaws, away from each other. The lower end of each handle member includes a gripping surface 12 and a transverse portion 13 extending outwardly therefrom that prevents a user's hand from sliding off the gripping surface and which allows the user to apply leverage to the handle members. An intermediate portion 14 of each handle member extends at a predetermined angle relative to the jaws while the gripping surface extends from the intermediate portion at a predetermined angle. The design allows the jaws to be horizontally oriented about a rod at which time the handles will be substantially vertical. One of the handle members includes a hook 35 mounted thereon for attaching the tool to a user's belt.

The device also includes an elongated bending bar 15 having a substantially U-shaped bracket 16 at an upper end thereof. The bracket includes a bottom portion 30 with two spaced opposing flanges 31 extending therefrom, each pivotally joined to one of the handle members immediately beneath a jaw. Disposed on one of the flanges is an elongated sleeve 21 having an externally threaded portion thereon. An elongated wire 23 having a mark or indica thereon is received within the sleeve. The wire is secured within the sleeve using a nut 25 that threadedly engages the externally threaded portion on the sleeve. The wire allows a user to align the indicia with a laser beam that is projected from an auxiliary source. By aligning the laser beam with the mark immediately prior to bending each rod, the user is assured that each support rod will be bent at the same distance from the floor.

To use the above described device, a user places the jaws about a ceiling support rod. The device is slid upwardly or downwardly until the indica on the measuring wire aligns with the projected laser beam. The handles are then compressed until the jaws tightly grip the rod. A user then pivots the bending bar upwardly until the support rod is bent back onto itself As the bar is pivoted, the bottom portion of the bracket will initially engage the rod. When the rod engages the flared portions, it is bent therearound and is encompassed by the bracket to form a U-shaped bend having a select width. The device allows a user to bend a plurality of rods at a select, identical distance from the floor; in addition, the bends formed in the rods will each have a consistent shape and dimension.

The above described device is not limited to the exact detail of construction and arrangement of parts shown and described. For example, the distance that the flared portions extend from the jaws may be varied to form loops in the wire rods having a desired dimension. Furthermore, the angle of the jaws and gripping portions relative to the remainder of the handles may be varied as well.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A tool for bending ceiling wire support rods comprising:

a pair of reciprocating handle members each having an upper end with a jaw thereon for receiving and gripping a ceiling support rod;

a rod bending bar pivotally attached to said handles which may be pivoted to engage and bend a rod being gripped by said jaws.

2. A tool for bending ceiling wire support rods according to claim 1 further comprising:

a height measuring means for allowing a user to grip and bend said rod at a select distance from the floor.

3. A tool for bending ceiling wire support rods according to claim 1 wherein said handles are normally biased away from each other so that said jaws are in a relatively spaced position.

4. A tool for bending ceiling wire support rods according to claim 2 wherein said height measuring means comprises:

an elongated wire attached to said bending bar, said wire having indica thereon for aligning with an external beam projected at a known height.

5. A tool for bending ceiling wire support rods according to claim 1 wherein the upper ends of said handles each include a flared portion extending a predetermined distance from said jaws for creating a bent portion in a rod having a predetermined dimension when said bending rod is bent about said flared portions.

6. A tool for bending ceiling wire support rods according to claim 1 further comprising a belt hook attached to one of said handles for attaching said tool to a user's belt.

* * * * *